US006657528B1

(12) United States Patent
Tang

(10) Patent No.: US 6,657,528 B1
(45) Date of Patent: Dec. 2, 2003

(54) SLOPE GAP INDUCTOR FOR LINE HARMONIC CURRENT REDUCTION

(75) Inventor: Allen Tang, Hong Kong (HK)

(73) Assignee: Astec International Limited, Hong Kong (HK)

( * ) Notice: Subject to any disclaimer, the term of this patent is extended or adjusted under 35 U.S.C. 154(b) by 22 days.

(21) Appl. No.: 09/895,444

(22) Filed: Jun. 29, 2001

Related U.S. Application Data

(60) Provisional application No. 60/227,953, filed on Aug. 25, 2000.

(51) Int. Cl.[7] ..... H01F 21/06; H01F 17/06

(52) U.S. Cl. ..... 336/178; 336/212; 336/223; 336/134

(58) Field of Search ..... 336/200, 134, 336/178, 165, 223, 212; 29/602.1

(56) References Cited

U.S. PATENT DOCUMENTS 3,603,864 A * 9/1971 Thaler ..... 363/126
3,958,465 A * 5/1976 Hiersig et al. ..... 475/1
4,795,959 A * 1/1989 Cooper ..... 323/308
5,155,676 A * 10/1992 Spreen ..... 363/126
5,506,764 A 4/1996 Hon et al.
6,232,864 B1 * 5/2001 Hosozawa et al. ..... 336/178

OTHER PUBLICATIONS

Wölfle, et al., "Power Factor Correction for AC–DC Converters with Cost Effective Inductive Filtering," *2000 IEEE*, pp. 332–337, Jun. 2000.

* cited by examiner

*Primary Examiner*—Anh Mai
(74) *Attorney, Agent, or Firm*—Coudert Brothers LLP

(57) ABSTRACT

A slope gap inductor for reducing line harmonic currents. The slope gap inductor comprises a first inductor core portion, and a second inductor core portion positioned relative to said first inductor core portion so as to form an inductor gap, wherein the second inductor core portion includes a sloped gap surface that forms a sloped gap portion of the inductor gap having a varying gap height, and wherein the sloped gap surface has a slope value that is selected so that the slope gap inductor has a selected inductance value responsive to a level of current in the inductor.

20 Claims, 15 Drawing Sheets

| | | | | |
|---|---|---|---|---|
| uo= | 1.26E-06 | | | |
| Core | E141-26 | 250W | Input W = | 350 |
| Length lm | 8.9 | cm | | |
| Ac | 3.38 | sq cm | | |
| Centre | 13 | mm | | |
| Leg | | | | |
| Ur | 1500 | | | |
| Bmax | 1.7 | T | | |
| N | 240 | | | |
| Correction factor k | | 0.7 | | |

| lg (cm) | % Ac | Elf Ac (sq cm) | L(mH) | Instant L (mH) | Eff Ave. L (mH) | I r | 493 $p^{-1/2}$ | k *493 $p^{-1/2}$ |
|---|---|---|---|---|---|---|---|---|
| 0.199755 | 33.000 | 1.115 | 3.923 | 3.923 | 11.879 | 11.600 | 19.420 | 13.594 |
| 0.199755 | 3.700 | 0.125 | 0.440 | 4.383 | 11.888 | 11.600 | 19.420 | 13.594 |
| 0.195547 | 3.700 | 0.125 | 0.449 | 4.812 | 12.045 | 11.383 | 19.622 | 13.735 |
| 0.161967 | 3.700 | 0.125 | 0.539 | 5.351 | 13.492 | 9.469 | 21.495 | 15.046 |
| 0.133984 | 3.700 | 0.125 | 0.647 | 5.998 | 15.120 | 7.891 | 23.546 | 16.482 |
| 0.110664 | 3.700 | 0.125 | 0.776 | 6.774 | 16.945 | 6.576 | 25.794 | 18.056 |
| 0.091231 | 3.700 | 0.125 | 0.931 | 7.705 | 18.979 | 5.480 | 28.256 | 19.779 |
| 0.075037 | 3.700 | 0.125 | 1.117 | 8.822 | 21.234 | 4.566 | 30.953 | 21.667 |
| 0.061542 | 3.700 | 0.125 | 1.341 | 10.163 | 23.717 | 3.805 | 33.907 | 23.735 |
| 0.050298 | 3.700 | 0.125 | 1.609 | 11.772 | 26.427 | 3.171 | 37.143 | 26.000 |
| 0.040925 | 3.700 | 0.125 | 1.931 | 13.703 | 29.358 | 2.643 | 40.688 | 28.482 |
| 0.033115 | 3.700 | 0.125 | 2.317 | 16.020 | 32.489 | 2.202 | 44.572 | 31.200 |
| 0.026607 | 3.700 | 0.125 | 2.780 | 18.800 | 35.783 | 1.835 | 48.826 | 34.178 |
| 0.021183 | 3.700 | 0.125 | 3.337 | 22.137 | 39.180 | 1.529 | 53.486 | 37.440 |
| 0.016684 | 3.700 | 0.125 | 4.004 | 26.141 | 42.589 | 1.274 | 58.591 | 41.014 |
| 0.012898 | 3.700 | 0.125 | 4.805 | 30.945 | 45.878 | 1.062 | 64.183 | 44.928 |
| 0.010025 | 11.500 | 0.389 | 17.621 | 48.566 | 48.566 | 0.900 | 69.721 | 48.805 |
| 0.010025 | 0 | | | | | | | |
| Total | 100 | | | | | | | |

FIG._9

| lg (cm) | % Ac | Elf Ac (sq cm) | L(mH) | Instant L (mH) | Equivalent L (mH) | I sat (A) | L = 493 x $P^{-1/2}$ (mH) | L = 0.7*493 x $P^{-1/2}$ (mH) |
|---|---|---|---|---|---|---|---|---|
| 0.2 | 38.480 | 1.301 | 4.568 | 4.568 | 13.601 | 11.618 | 19.406 | 13.584 |
| 0.2 | 2.850 | 0.096 | 0.338 | 4.906 | 13.601 | 11.618 | 19.406 | 13.584 |
| 0.183 | 2.850 | 0.096 | 0.369 | 5.275 | 12.497 | 10.659 | 20.529 | 14.182 |
| 0.166 | 2.850 | 0.096 | 0.405 | 5.680 | 13.211 | 9.700 | 21.237 | 14.866 |
| 0.149 | 2.850 | 0.096 | 0.450 | 6.130 | 14.038 | 8.741 | 22.371 | 15.680 |
| 0.132 | 2.850 | 0.096 | 0.505 | 6.635 | 15.010 | 7.783 | 23.709 | 16.597 |
| 0.115 | 2.850 | 0.096 | 0.576 | 7.210 | 16.187 | 6.824 | 25.320 | 17.724 |
| 0.098 | 2.850 | 0.096 | 0.670 | 7.881 | 17.655 | 5.865 | 27.311 | 19.118 |
| 0.081 | 2.850 | 0.096 | 0.801 | 8.682 | 19.565 | 4.906 | 29.861 | 20.902 |
| 0.064 | 2.850 | 0.096 | 0.996 | 9.677 | 22.208 | 3.948 | 33.290 | 23.303 |
| 0.047 | 2.850 | 0.096 | 1.315 | 10.992 | 26.227 | 2.989 | 38.258 | 26.781 |
| 0.03 | 5.380 | 0.182 | 3.645 | 14.646 | 33.421 | 2.030 | 46.420 | 32.494 |
| 0.025 | 5.380 | 0.182 | 4.244 | 16.890 | 36.449 | 1.748 | 50.024 | 35.017 |
| 0.02 | 5.380 | 0.182 | 5.060 | 23.950 | 39.826 | 1.465 | 54.623 | 38.236 |
| 0.015 | 5.380 | 0.182 | 6.265 | 30.215 | 43.605 | 1.184 | 60.778 | 42.545 |
| 0.01 | 11.500 | 0.389 | 17.575 | 47.790 | 47.790 | 0.902 | 69.630 | 48.741 |
| | | | | | | | | |
| Total | 100 | | 47.790 | | | | | |

FIG._14

SLOPE GAP INDUCTOR FOR LINE HARMONIC CURRENT REDUCTION

CROSS REFERENCE TO RELATED APPLICATIONS

This Application claims priority from co-pending U.S. Provisional Patent Application No. 60/227,953 filed on Aug. 25, 2000 and entitled, SLOPE GAP INDUCTOR FOR LINE HARMONIC CURRENT REDUCTION, the disclosure of which is incorporated herein in its entirety for all purposes.

FIELD OF THE INVENTION

The present invention relates to inductors, and more particularly, to a slope gap inductor for reducing line harmonic currents.

BACKGROUND OF THE INVENTION

The introduction of personal computers has created a need for low cost and efficient power systems for home use. These power systems are required to meet specific operating parameters, and in particular, should meet predetermined specifications for line harmonic levels. For personal computers, the requirements for line harmonic levels can be found in the EN61000-3-2 LHC requirements published in the International Electrotechnical Commission (IEC) Publication 1000-3-2 (first edition; 1995).

FIG. 1 shows a graph of the worst case harmonic current that is allowable under the EN61000 specification. The graph shows harmonic current normalized to 1 watt where all harmonic peaks happen to be in phase with each other. Typically, the harmonic current would appear more as a sine wave like waveform when the peaks are not in phase.

A conventional apparatus for limiting harmonic current uses a bridge rectifier followed by a boost circuit. Line harmonic correction of a rectified AC supply can result in a large amount of ripple current in the secondary circuits. In the past, keeping the output of these secondary circuits within acceptable ripple limits has required use of very large amounts of storage capacitance.

Techniques for harmonic correction without excessive ripple also include use of two independent conversion stages, a power factor correcting stage and DC-to-DC conversion. Other line harmonic correction techniques include using an auxiliary winding on the isolation transformer that can either be cyclically disconnected, or used with a clamp switch to charge a hold up or bulk capacitor.

A typical solution for improving the line harmonic current is to add an inductor in the input line, where the added inductor enlarges the conduction angle of the AC line current. FIGS. 2*a–b* show exemplary circuits having an inductor placed in the AC line input. The amount of the line harmonic current suppression achieved by this technique relies on the inductance value.

It is apparent that a higher inductance is required at a lighter load to achieve the same current waveform as full load, as the required current change rate of di/dt is lower at light loads. The inductance requirement is also a function of input power level. A higher inductance is required for a lower input power.

Normally, laminated iron with a fixed air gap is used for the core of the inductor, and the inductance value is almost constant over the expected input power range, as long as the core is not saturated. For a fixed load application, the inductor design can always be optimized at that loading condition. However, in a wide range load application, the inductance is over-designed at the full load. This either requires a bigger inductor or using smaller wire size with more turns to get a higher inductance values for light loads, with the penalty of increasing copper loss at full loads. Step gap inductors have been used in prior art devices but the result is that the inductors of the device can only be optimized for a limited load range.

Therefore, it would be desirable to have a way to reduce line harmonic currents without the addition of extra components that increase the cost and complexity of the power system.

SUMMARY OF THE INVENTION

The present invention includes a slope gap inductor to reduce line harmonic current (LHC). For example, the slope gap inductor can be used to reduce LHC in a power supply with. a capacitive load to the AC input line. The slope gap inductor results in a inductance value that varies as a function of current. This current dependent inductance optimally meets the EN61000 requirements at a wide range of loading conditions, e.g., from 50 watts to full power. The inventive air gap design enables the inductor's inductance value to be determined according to the inductor current. This allows for a reduced number of turns in the windings of the inductor and a minimum core size, since the required inductance (at the same power level) can be much lower than that of a typical uniform gap inductor, where the inductor can only be optimized for a fixed load application. A reduction in "copper loss" in the inductor windings is also thereby achieved because of the reduced number of winding turns in the inductor according to the present invention. Copper loss is defined as the resistance of the windings times the square of the conduction current.

Utilization of a slope gap inductor provided in accordance with the present invention allows efficient circuit operation with a wider range of loads and provides greater reduction in harmonics and ripple currents than possible with conventional design techniques. Furthermore, the reduction in harmonics and ripple currents can be achieved without increased amounts of storage capacitance.

In a preferred embodiment of the present invention, a slope gap inductor for use in an electronic circuit to reduce line harmonic current is provided. The slope gap inductor comprises a first inductor core portion, and a second inductor core portion positioned relative to said first inductor core portion so as to form an inductor gap, wherein the second inductor core portion includes a sloped gap surface that forms a sloped gap portion of the inductor gap having a varying gap height, and wherein the sloped gap surface has a slope value that is selected so that the slope gap inductor generates an inductance value responsive to a level of current in the inductor.

BRIEF DESCRIPTION OF THE DRAWINGS

The forgoing aspects and the attendant advantages of this invention will become more readily apparent by reference to the following detailed description when taken in conjunction with the accompanying drawings wherein:

FIG. 9 shows a worksheet for calculating gap and effective average inductance at different rate current;

FIG. 14 shows worksheet with the slope gap values pre-selected;

DETAILED DESCRIPTION OF THE INVENTION

The present invention includes a slope gap inductor to reduce line harmonic current (LHC) in electronic circuits such as power supply circuits.

Figure 3A:
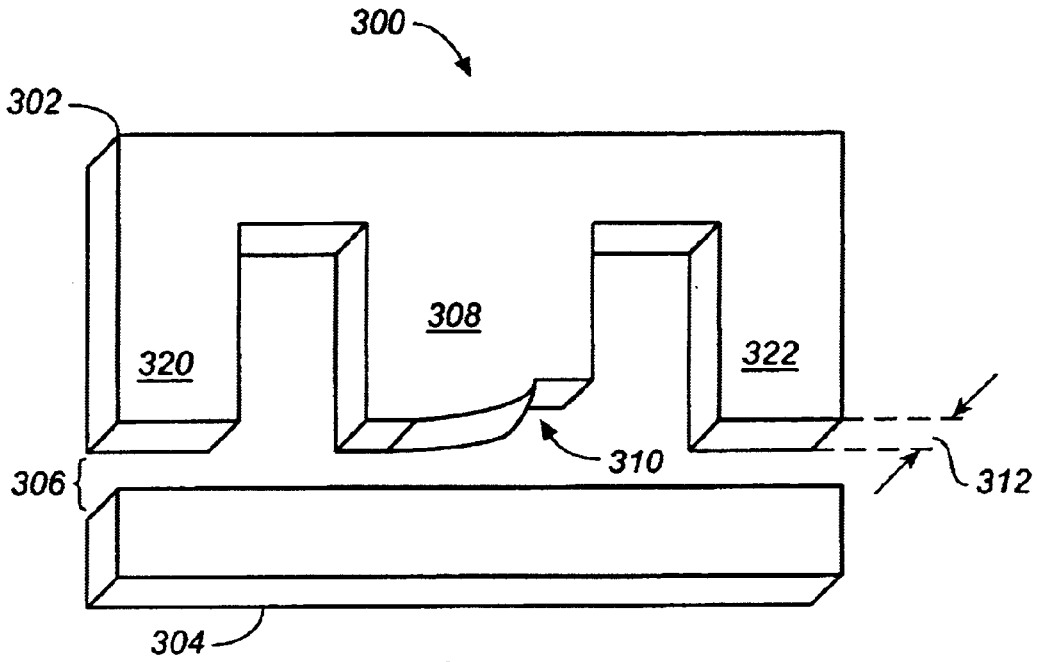
FIG. 3*a* shows a profile of a slope gap inductor core according to one embodiment of the present invention.

FIG. 3*a* shows an air gap profile of an inductor core 300 according to one embodiment of the present invention. The inductor core comprises a first core structure 302 that is shaped similarly to the letter "E", i.e., it has three legs, and a second core structure 304 that is shaped similarly to the letter "I." Thus, the inductor core 300 is referred to as an "EI" inductor core. The inductor core 300 also has a predetermined thickness shown at 312 and illustrated in more detail in FIG. 3*b*.

The inductor structures (302, 304) are positioned relative to each other such that an inductor air gap 306 is formed. The first core structure 302 includes a center leg or portion 308 that is profiled to form a gap of varying size (shown at 310) with the second core structure 304. Note that air gap 306 may have a zero width gap or a finite gap. The resultant gap distance is the sum of the gaps 306 (center gap plus side gap) in each leg of the core structure 302.

The core structure 302 also includes leg structures 320 and 322 that include gap surfaces that form gaps with respect to core structure 304. For the remainder of the description, it will be assumed that these gaps contribute to the overall inductance value, and their contribution can be determined in a manner similar to the described embodiments of the present invention. Therefore, the detailed description will focus on the inventive gap design provided by the slope gap surface, for example, as shown at 310, and it will be assumed that the contribution to inductance from the gaps of the leg structures can be easily incorporated.

Figure 3B:
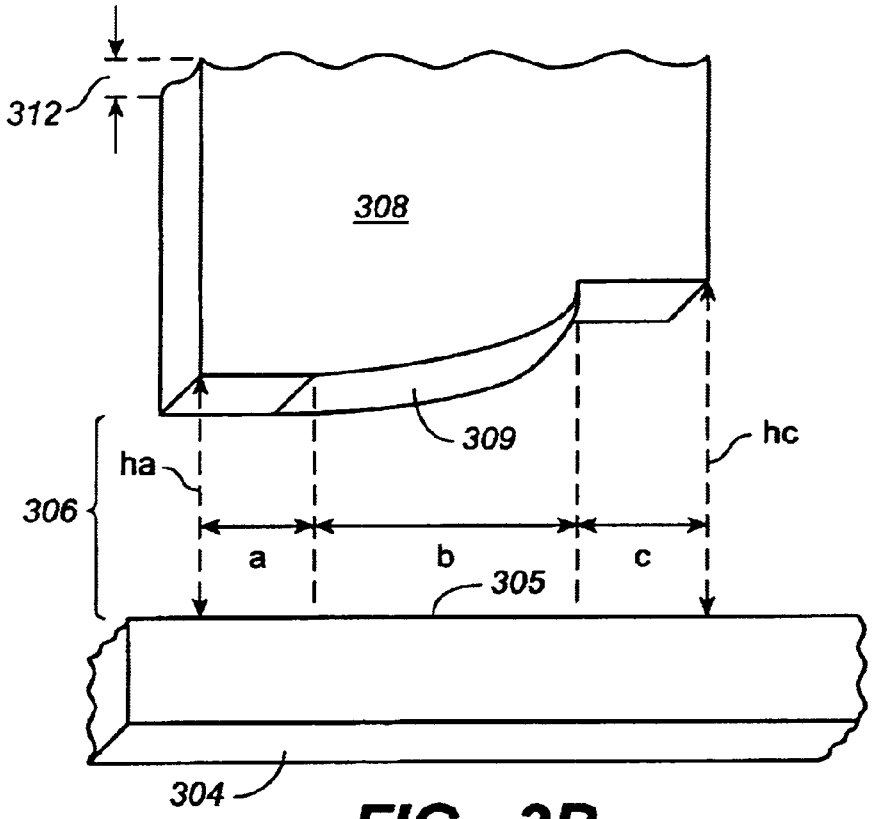
FIG. 3*b* shows an enlarged view of a center portion of the inductor core of FIG. 3*a;*

FIG. 3*b* shows a blow-up of the inductor center portion 308 along with a corresponding portion of the second inductor structure 304 so that it is possible to more clearly see the inductor gap 306 that is formed at that region of the core 300.

The portion of the air gap 306 formed by a bottom surface 309 of structure 308 and a top surface 305 of structure 304 includes three portions shown at regions a, b, and c. Regions a and c have gaps that have constant heights. For example, the gap at region a has a height of ha, while the gap at region c has a height of hc, as shown in FIG. 3*b*.

The portion of the air gap 306 formed in region b is formed by the variable slope of the bottom surface 309, so that the air gap in region b has a variable height. The height of the gap of region b ranges from height ha to hc. In other words, the gap height of region b is not a fixed value, but varies as a function of the variable slope of the surface 309 of leg 308. The shape of this variable slope of structure 308 is specified so as to tune the inductance change rate against the inductor current in accordance with the present invention.

Inductance Requirements

An inductance value (L) can be computed from the equation:

$$L=V/(di/dt);$$

where V is the voltage across the inductor and di/dt the rate of change of the current through the inductor. In a line harmonic reduction circuit, this di/dt is proportional to the input current. Thus, L is inversely proportional to the input current (or input power), and is proportional to the voltage drop across the inductor. Assuming an infinite bulk capacitor in the line harmonic reduction circuit, the voltage drop across the inductor is the difference between an input sine wave peak voltage and the bulk voltage. In practice, this voltage drop depends on the regulation drop due to the internal resistance R of the inductor and the ripple voltage of the bulk capacitor. The regulation drop is proportional to the inductor current, while the ripple voltage is approximately proportional to the square root of the input power (or current, as power is proportional to ½ $CV^2$). Thus, L is proportional to $(IR+I^{1/2})/I=R+I^{-1/2}$ and the required inductance can be written as:

$$L=k_1+k_2*I^{-1/2}$$

where $k_1$ and $k_2$ are constants and can be acquired experimentally.

Figure 4:
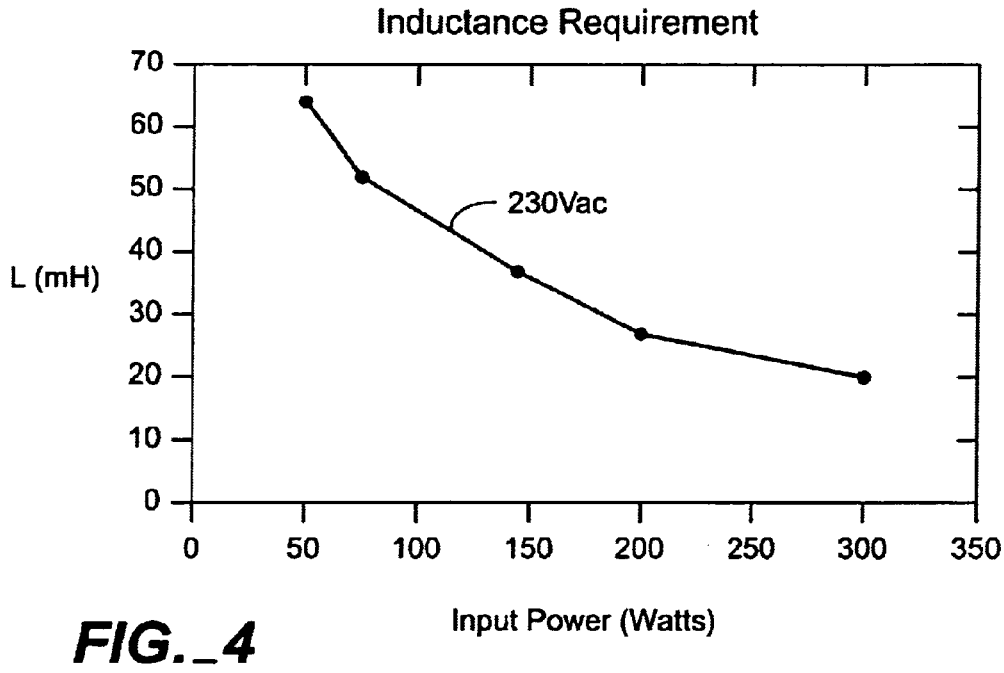
FIG. 4 shows a plot of required inductance at different loading conditions for a typical uniform gap core.

FIG. 4 shows experimental data representing the required inductance at different loading conditions for a typical prior art uniform gap core. At infinite power, the required L will approach zero, thus $K_1$ will be zero. As a result, if P is the input power:

$$L=k_2k_3*P^{-1/2}$$

where $k_3^2*P=I$

Figure 5:
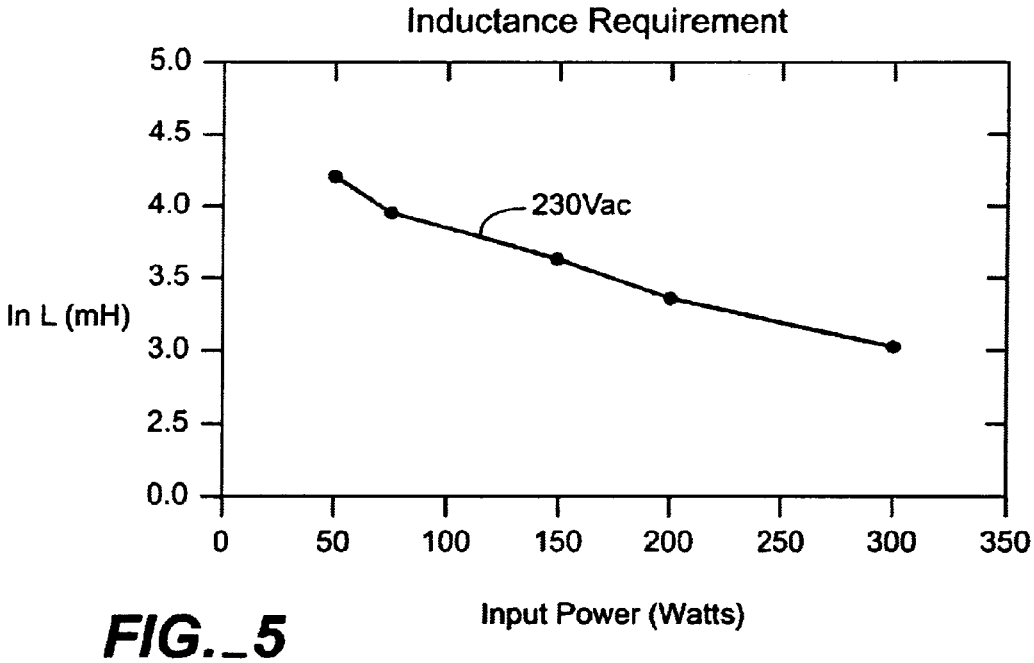
FIG. 5 shows the inductance requirement illustrated in FIG. 4 and plotted in a natural log (ln) scale.

FIG. 5 shows the inductance requirement illustrated in FIG. 4 with only the inductance plotted in a natural log (ln) scale. When both the inductance and the input power are plotted in the ln scale, the plotted data forms a straight line with a slope of ½ and $\ln(k_2k_3)$ will be the intersection of the extrapolated line at the y-axis. In this case the intersection at the y-axis is 6.2. Thus, the following values can be determined:

$$k_2k_3=e^{6.2}=493$$

$$L=493\ P^{1/2}$$

Slope Gap Core Design

In accordance with the present invention, a slope gap core will now be described in detail. Referring again to FIG. 3*b*, therein is shown core portion 308 having gap regions a, b, and c, respectively, wherein region b provides a variable gap distance.

Figure 6:
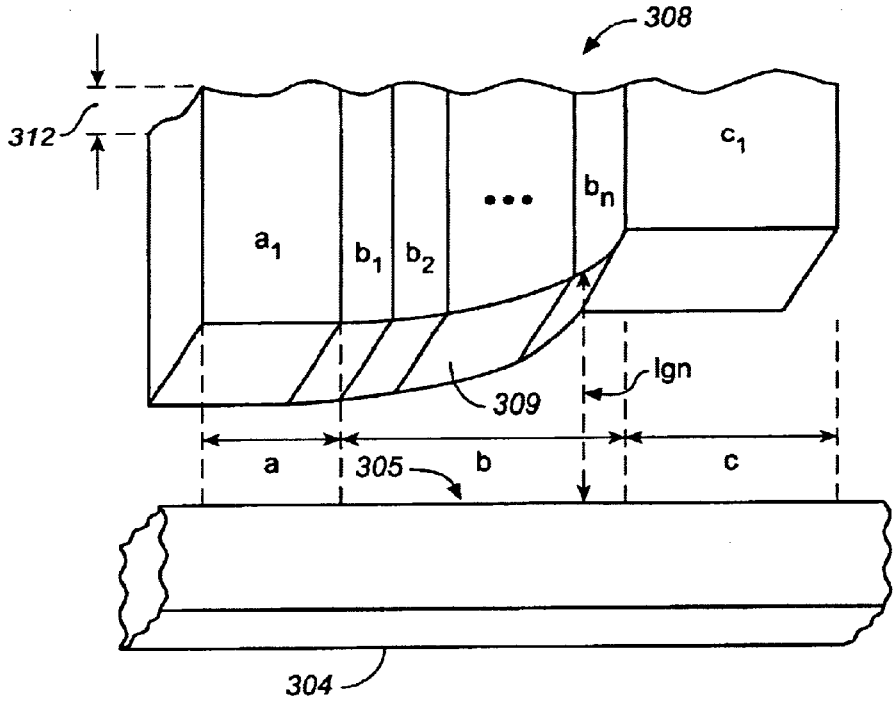
FIG. 6 shows the center portion of the inductor core of FIG. 3*b* divided into a plurality of sub-sections each having a cross sectional surface area.

FIG. 6 shows this center core portion at 308 divided into a plurality of sub-sections. The subsections include subsection a1 that is associated with region a, and subsection c1 that is associated with region c. Also shown are subsections $b_1$–$b_n$ that are associated with region b. The $b_n$ subsections are defined to each have the same cross-sectional surface area along the bottom surface 309 of core portion 308, each cross sectional area facing the top surface 305 core structure 304.

Figure 7:
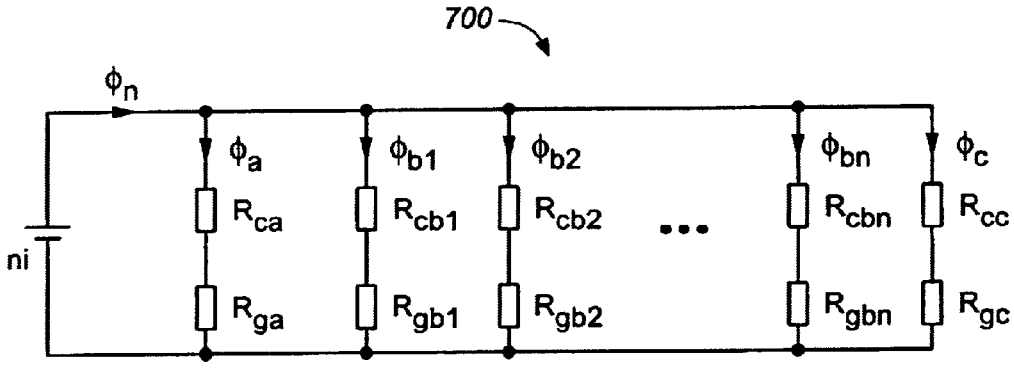
FIG. 7 shows a magnetic circuit representative of the sub-sections shown in FIG. 6.

FIG. 7 shows a magnetic circuit 700 that is representative of the subsections shown in FIG. 6. The value of $\phi_n$ can be expressed as:

$$\phi_n=ni/(R_c+R_g)=BA$$

where B is the flux density, A is the cross-sectional area of the portion of interest and n is the number of turns. Furthermore, $R_c$ is the magnetic impedance of the core, while $R_g$ is the magnetic impedance of the gap. These can be expressed as:

$$R_c=l_c/\mu A$$

$$R_g=l_g/\mu_o A$$

where the symbol $\mu$ is the permeability of the core and the symbol $\mu_o$ is the permeability of air. For a specific core, the saturation current ($I_r$) at the rth segment of a, $b_1$, $b_2$, . . . $b_n$, and c, can be calculated by:

$$I_r=BsatA(R_{cr}+R_{gr})/n$$

where Bsat is the saturated flux density. The saturation current $I_r$ can then be expressed as:

$$I_r=Bsat(l_{cr}/\mu+l_{gr}/\mu_o)/n$$

$$l_{gr}=\mu_o nI_r/Bsat-l_{cr}/\mu_r$$

where $l_{cr}$ and $l_{gr}$ are the length of the core and the gap, respectively, and $l_{cr}$ is approximately equal to $l_m$, which is the magnetic path length, and:

$$l_{cr}+l_{gr}=l_{mr}$$

where if $l_{gr}$ is negligible:

$$l_{gr}=\mu_o nI_r/Bsat-l_m/\mu_r$$

The inductance of each portion is shown in the following expressions whenever the inductor current is below the saturation current, as defined by the previous formula.

$$\begin{aligned} L_a &= n^2/(R_{ca}+R_{ga}) & & L_a = n\ A_a\ Bsat/I_a \\ L_{b1} &= n^2/(R_{cb1}+R_{gb1}) & & L_{b1} = n\ A_{b1}\ Bsat/I_{b1} \\ L_{b2} &= n^2/(R_{cb2}+R_{gb2}) & \text{or} & L_{b2} = n\ A_{b2}\ Bsat/I_{b2} \\ &\ldots & & \ldots \\ L_{bn} &= n^2/(R_{cbn}+R_{gbn}) & & L_{bn} = n\ A_{bn}\ Bsat/I_{bn} \\ L_c &= n^2/(R_{cc}+R_{gc}) & & L_c = n\ A_c\ Bsat/I_c \end{aligned}$$

The inductance of each segment is not related to the permeability of the core material. It only depends on the saturation flux density. It also shows that the segment inductance is a function of the product of nA (turn number*cross-sectional area) at each current level. This means the nA product must be constant for a specific inductance requirement at a specific current level. Disregarding the eddy current loss, the thickness of the iron lamination is not critical, only the total cross-sectional area is important.

The instantaneous inductance $L_r'$ at a rated inductor current $I_r$ is the summation of the inductance of all unsaturated segments, which have higher saturation current. Thus:

$$L_a'=L_c+L_{bn}+\ldots+L_{b3}+L_{b2}+L_{b1}+L_a$$

$$L_{b1}'=L_c+L_{bn}+\ldots+L_{b3}+L_{b2}+L_{b1}$$

$$L_{b2}'=L_c+L_{bn}+\ldots+L_{b3}+L_{b2}$$

. . .

$$L_r'=L_c+L_{bn}+\ldots+L_r$$

. . .

$$L_{bn}'=L_c+L_{bn}$$

$$L_c'=L_c$$

which can be rewritten as:

$$L_a'=nBsat(A_c/I_c+A_{bn}/I_{bn}+\ldots+A_{b3}/I_{b3}+A_{b2}/I_{b2}+A_{b1}/I_{b1}+A_a/I_a)$$

$$L_{b1}'=nBsat(A_c/I_c+A_{bn}/I_{bn}+\ldots A_{b3}/I_{b3}+A_{b2}/I_{b2}+A_{b1}/I_{b1})$$

$$L_{b2}'=nBsat(A_c/I_c+A_{bn}/I_{bn}+\ldots+A_{b3}/I_{b3}+A_{b2}/I_{b2})$$

. . .

$$L_r'=nBsat(A_c/I_c+A_{bn}/I_{bn}+\ldots+A_r/I_r)$$

. . .

$$L_{bn}'=nBsat(A_c/I_c+A_{bn}/I_{bn})$$

$$L_c'=nBsat(A_c/I_c)$$

At light current, the instantaneous inductance is the sum of all the terms $L_a$, $L_n$ and $L_c$. When the current increases, portions a, b1, b2, . . . br, . . . bn−1 will be gradually saturated and the corresponding $L_a$, $L_b$'s will be subtracted from the total inductance. At maximum current only part of the portion $b_n$ and the whole portion c are operating in the linear region of the B-H curve. The portion c provides the minimum inductance requirement at maximum current peak.

The input charging current in the bridge rectification circuit is a discontinuous pulse current at line frequency. The inductance of the slope gap inductor will vary with the current amplitude starting with a highest inductance $L_a'$ at zero current and then gradually reducing to $L_{b1}'$, $L_{b2}'$ . . . and then $L_r'$ at the peak current. In order to correlate to the inductance requirement curve of FIG. 4, in which a constant inductance is referred to, the effective average inductance should be used for the slope gap core inductor. The effective average inductance from zero ampere to the rated current is given by:

$$L_a(ave)=L_a' \text{ at } I_a$$

$$L_{b1}(ave)=[L_a(ave)I_a+L_{b1}'(I_{b1}-I_a)]/I_{b1}$$

$$L_{b2}(ave)=[L_{b1}(ave)I_{b1}+L_{b2}'(I_{b2}-I_{b1})]/I_{b2}$$

. . .

$$L_r(ave)=[L_{r-1}(ave)I_{r-1}+L_r'(I_r-I_{r-1})]/I_r$$

. . .

$$L_{bn}(ave)=[L_{b(n-1)}(ave)I_{b(n-1)}+L_{bn}'(I_{bn}-I_{b(n-1)}]/I_{bn}$$

$$L_c(ave)=[L_{bn}(ave)I_{bn}+L_c'(I_c-I_{bn})]/I_c$$

The rate of change of an average inductance should follow a curve similar to that shown in FIG. 4. The required inductance decreases exponentially with increasing input power (and hence the RMS current). The expressions for the $L_{b(ave)}$'s also decrease exponentially, with $R_{gb}$'s, and hence $l_{gb}$'s when $R_{cb}$'s is being considered constant as $l_{cb}$ is approximately unchanged. However, the change rate may not match the inductance requirement. To adjust for this, the $l_{gb}$'s change rate can be tuned by adjusting the slope of the gap profile, which may also be exponentially increasing.

It should be noted that the inductance requirement depicted in FIG. 4 was obtained by experimentation with a constant inductance at each power level. With a typical uniform gap design, the inductance is constant over the whole charging current profile. However, with a slope gap designed in accordance with the present invention, this requirement is only applied at the maximum voltage across the inductor, which approximately occurs at the peak of the input sine waveform and the instantaneous current is only about half of the peak current. At higher currents, the required inductance can be lower, theoretically dropping as a cosine function. As a result, the energy storage in the inductor can be less and the core can be smaller.

Gap Design Method

The following steps are used to design a slope gap inductor in accordance with one embodiment of the present invention. Although specific steps are shown, it is possible that steps may be combined, modified, or rearranged without deviating from the scope of the embodiment. The design steps are as follows.

Figure 1:
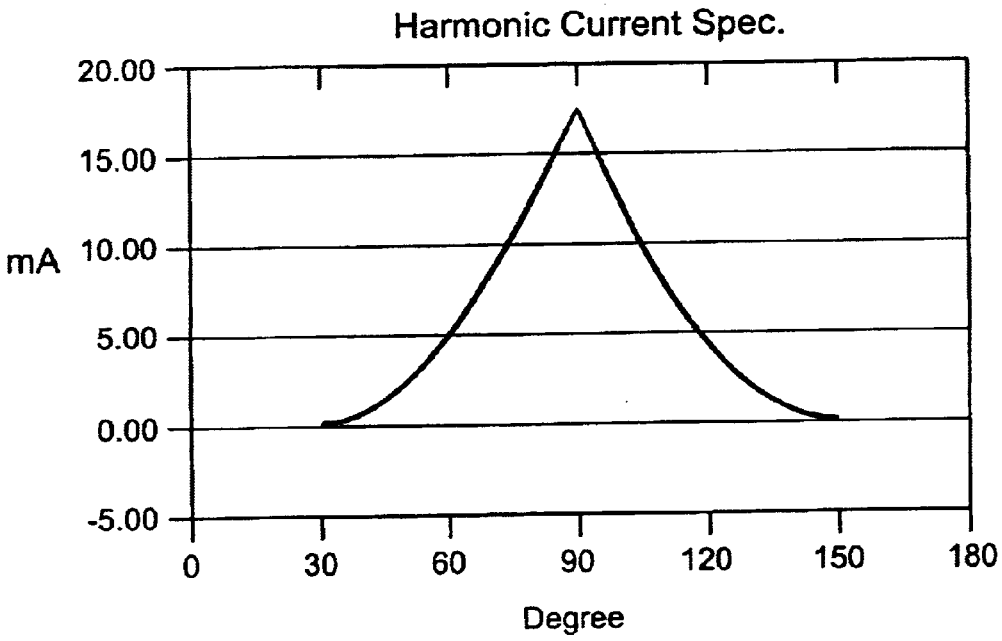
FIG. 1 shows a worst-case current waveform normalized to 1 Watt that is within the EN61000 standard.
Figure 2A:
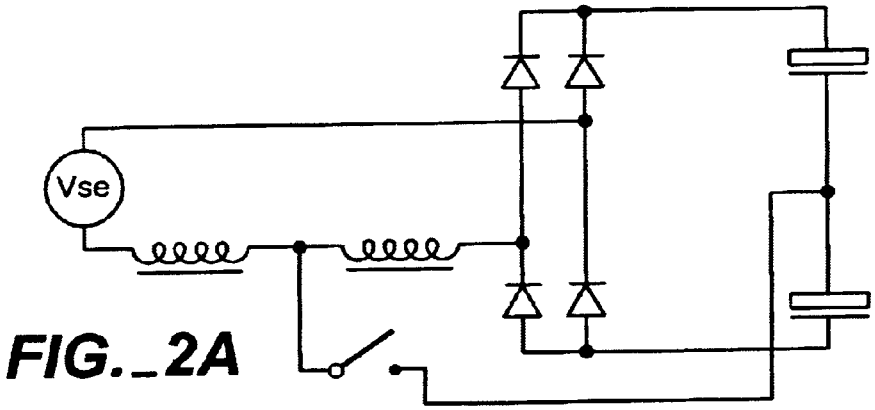
FIGS. 2*a–b* show typical line harmonic reduction circuits.
Figure 2B:
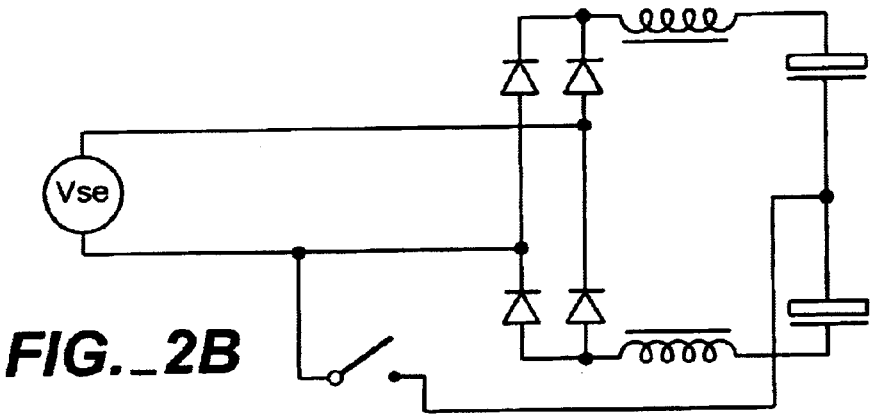

1. Determine the maximum allowable input peak current at both nominal and minimum input voltage.
2. Determine the peak current at minimum load.
3. Select a core size and geometry for the inductor.
4. Determine the maximum allowable resistive loss for the inductor winding.
5. Calculate the maximum turns number and wire gauge. The calculations performed in steps 6–9 can be done using numerical methods.
6. Calculate the minimum gap ($l_{ga}$ for portion a) for the minimum current condition, and the maximum gap ($l_{gc}$ for portion c) for the maximum current.
7. Calculate the gap lengths at different current levels between the minimum and the maximum current using incremental steps. For example, 15 incremental steps may be used.
8. Calculate each segment inductance.
9. Derive the instantaneous inductance from the segment inductance, and derive the effective average inductance from the instantaneous inductance at each current level.
10. Plot a curve of effective average inductance against current. The effective average inductance is compared to the theoretical curve represented by:

$$L=493\ k'P^{-1/2}=493\ k'(I/0.0018)^{-1/2}$$

where it peak current I=0.018P from FIG. 1. The segment cross-sectional areas are tuned to get the two curves as close as possible, while the total gap volume is maintained as large as possible to provide for maximum energy storage.

11. Determine if the whole effective average inductance curve is far below the theoretical curve. If so, a higher nA product (i.e. bigger cross-sectional area or more turns) has to be chosen and steps 3–10 performed again. However, if the whole effective average inductance curve is above the theoretical curve, then a lower nA product (i.e. smaller cross-sectional area or less turns) can be used.

Implementation Example

The following provides a implementation example for designing a slope gap inductor in accordance with the present invention.

Figure 8:
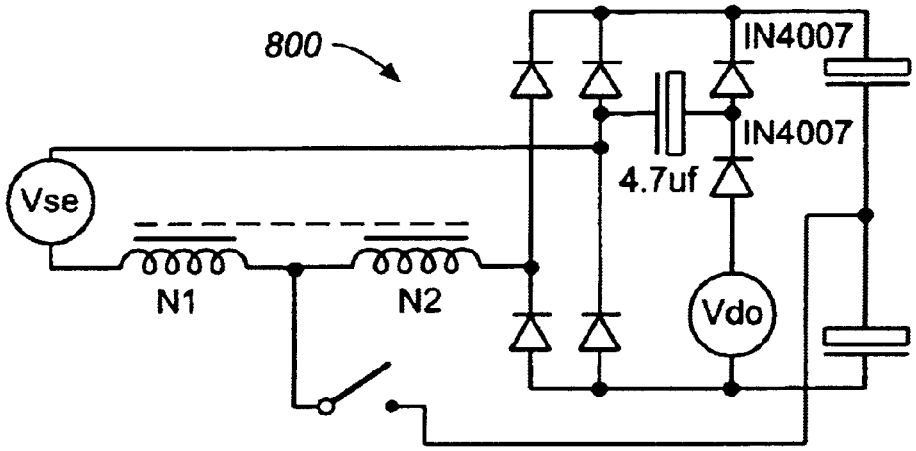
FIG. 8 shows a capacitive boost circuit wherein the slope gap core design according to the present invention is used.

FIG. 8 shows an exemplary capacitive boost circuit 800 for which a slope gap inductor according to the present invention be designed. When the slope gap core design is incorporated into the capacitive boost circuit, the required inductance can be reduced by approximately 30%. In the circuit 800, $V_{dc}$ is 15 V, the indicated capacitor is 4.7 $\mu$F, and the indicated diodes are IN4007 type diodes. The required inductance L can be modified as $L=493\ k'P^{-1/2}$ wherein the correction factor for "capacitive boost" is k', where k' is about 0.7.

The design is for a capacitive boost circuit having a power capacity of approximately 250 Watts. An iron core (EI 41-26) having a cross-sectional area of 3.38 sq. cm, a magnetic path length of 8.9 cm, saturation flux density of 1.7 T and relative permeability of 1500 was selected.

FIG. 9 shows a worksheet for calculating gap and effective average inductance at different rate current ($I_r$) for high range operation using the slope gap design method described above. Once the slope gap contour is designed for high range operation, the design for low range operation is simple, since it needs to only determine the turns number for N1.

Figure 10:
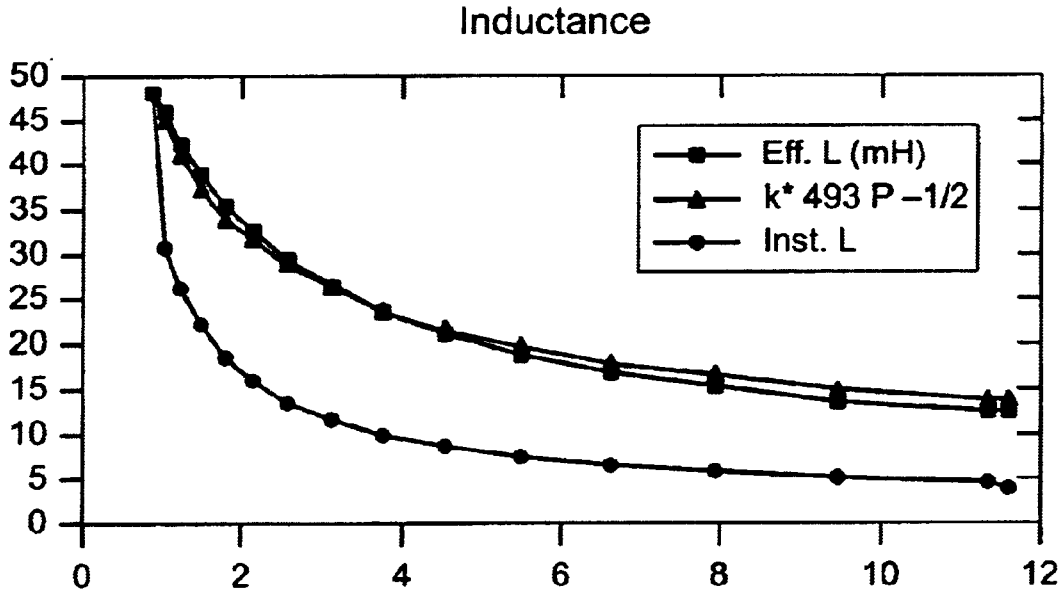
FIG. 10 shows a graph of inductance values calculated in the worksheet of FIG. 9.

FIG. 10 shows curves for the effective average inductance and the theoretical inductance plotted against the rated current. The theoretical inductance can be described by:

$$L=493\ k'P^{-1/2}=493\ k'(I/0.018)^{-1/2}$$

Figure 11:
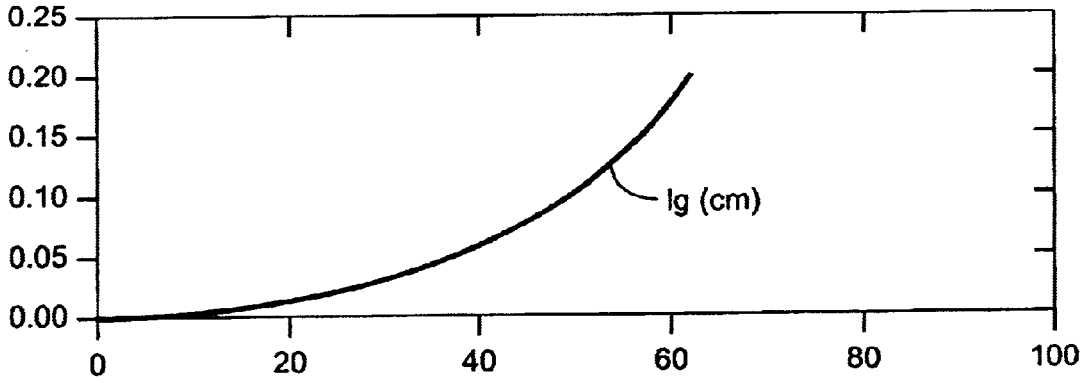
FIG. 11 shows a gap contour derived from values calculated in the worksheet of FIG. 9.

FIG. 11 shows a gap contour derived from values calculated in the worksheet of FIG. 9. The gap contour can be viewed by plotting the gap length (lg) against the accumulative percentage cross-sectional area (% Ac). The contour is approximately the optimized gap design for the power range of interest. However, for ease of implementation, it is possible to represent the contour as two straight slopes that are used for the b portion of the core to perform performance verification.

Figure 12:
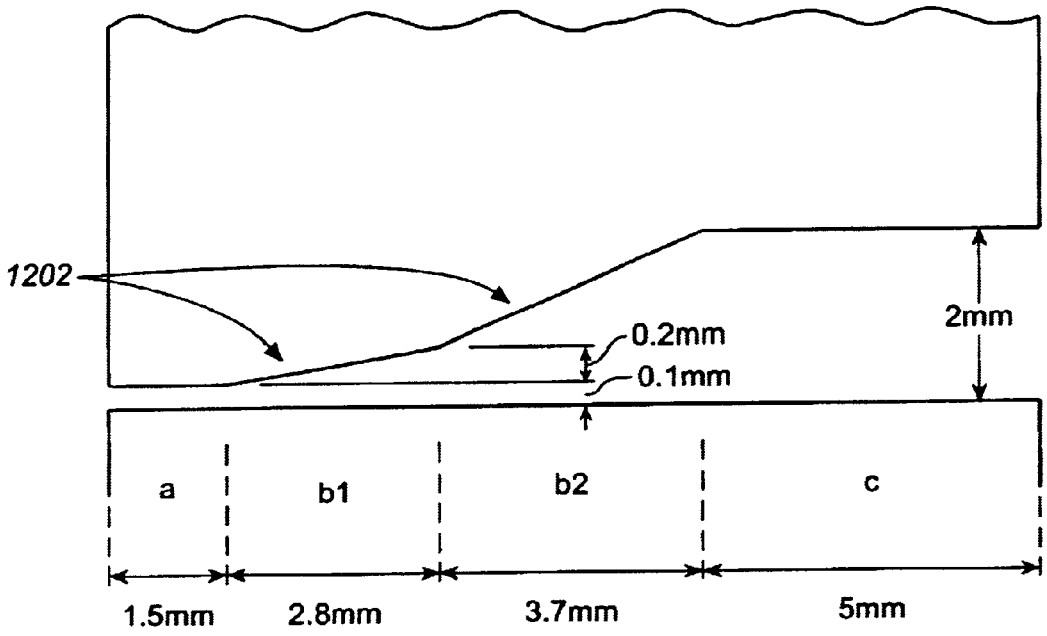
FIG. 12 shows a gap profile in accordance with one embodiment of the present invention.

FIG. 12 shows a slope gap profile in accordance with this embodiment of the invention, wherein the b portion is represented by two straight slope portions as indicated at 1202. Thus, the slope gap results of FIG. 11 are estimated in FIG. 12 using two straight slope portions in the b region.

Figure 13B:
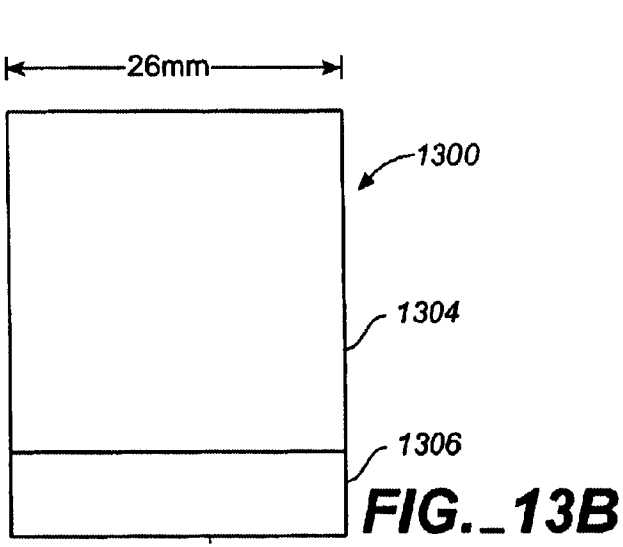
FIGS. 13*a–c* show an EI core structure resulting from the worksheet values of FIG. 9.
Figure 13A:
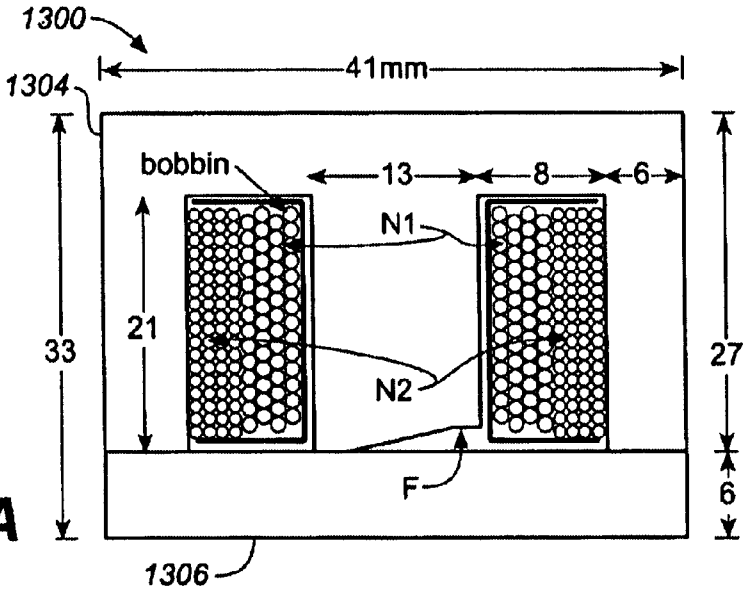
Figure 13C:
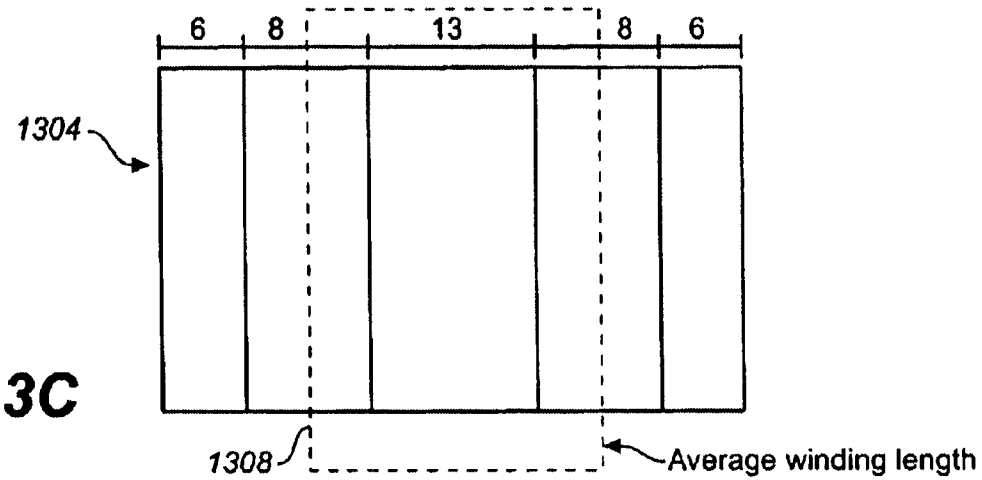

FIGS. 13*a–c* show an EI core structure 1300 resulting from the worksheet values of FIG. 9 that has a slope gap in accordance with the profile of FIG. 12. The core structure is constructed from 0.5 mm thickness iron sheet with a surface area of 10.7 sq, cm (including gap area). The structure 1300 has a winding area of 1.68 sq. cm and a magnetic path length of 8.9 cm.

FIG. 13*a* shows a front view of the core structure 1300 and indicates that the core structure is 33 mm high and 41 mm long. The E structure 1304 is 27 mm high and the I structure 1306 is 6 mm high. Also shown in the FIG. 13*a* is the slope gap profile described above and indicated at F, and a cross sectional view of small windings N2, and large windings N1. The slope gap profile shown at F is representative of the profile shown in FIG. 12.

FIG. 13*b* shows an end view of the core structure 1300 and indicates that the core structure 1300 is 26 mm wide. FIG. 13*c* shows a bottom view of the E structure 1304 and indicates a path 1308 representing the average winding length of approximately 11 cm. FIG. 13*c* also shows other dimensions of the core structure given in millimeters (mm).

FIG. 14 shows a worksheet with the slope gap values pre-selected according to the profile of FIG. 12.

Figure 15:
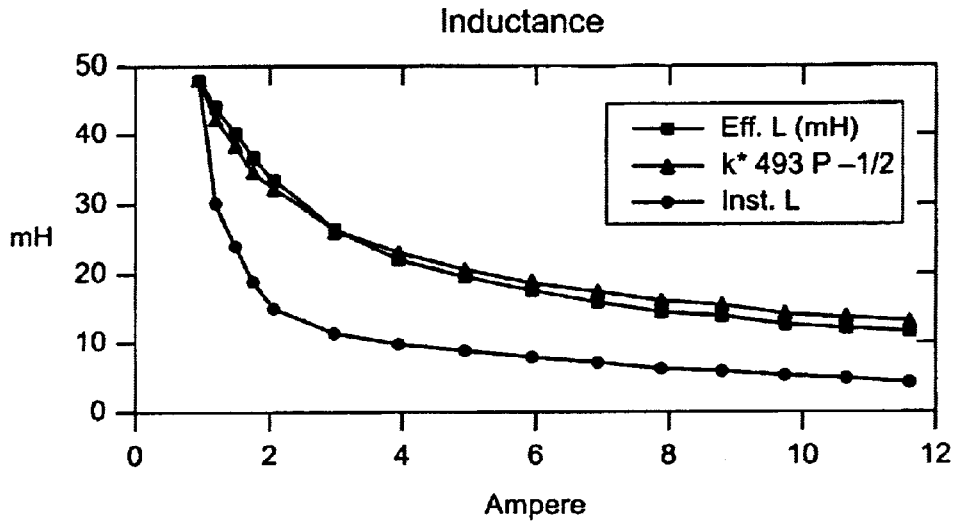
FIG. 15 shows graph of inductance values from the worksheet of FIG. 14.

FIG. 15 shows a graph of inductance values from the worksheet of FIG. 14.

Figure 16:
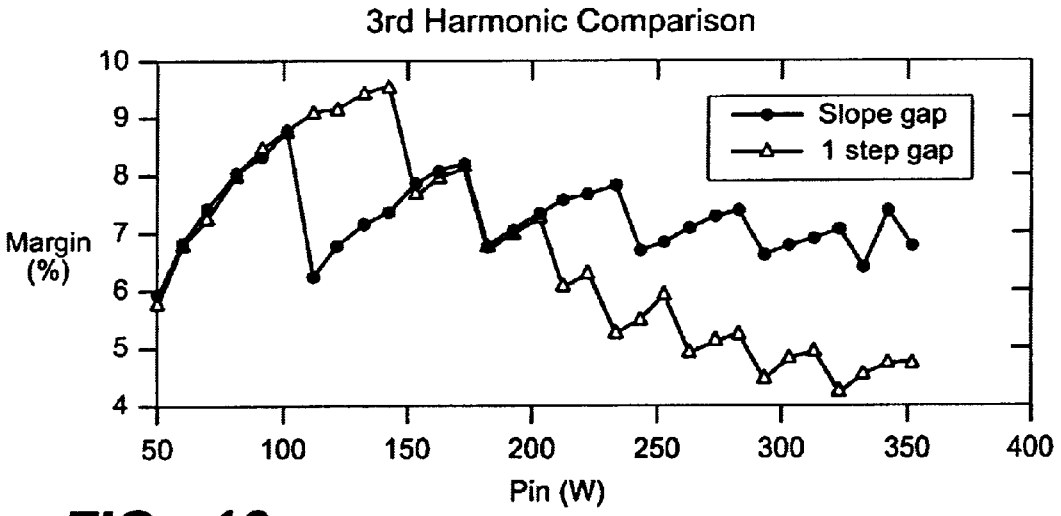
FIG. 16 shows 3$^{rd}$ harmonic comparison graph.

FIG. 16 shows a $3^{rd}$ harmonic comparison graph between the slope gap inductor as designed above, and a typical step gap inductor over a power range of 50 to 350 Watts. As can be seen from FIG. 16, the slope gap inductor produces an even design margin over the entire power range as opposed to the step gap inductor, which actually falls below the EN61000 requirement at the higher power levels.

Therefore the slope gap inductor provides an optimized inductor to limit the harmonic current for a wide range of input power to meet the requirements of the EN61000 standard.

Alternative Gapping Techniques

Although described above with reference to an "EI" core structure, one or more embodiments of the invention are suitable for use with other types of core structures. The following is a description of other core structures and arrangements FIG. 17 shows an inductor 1700 formed from a "bridge" gap technique in accordance with one embodiment of the present invention. The inductor 1700 has an E structure 1702 and an I structure 1704 that form a gap 1706. The E structure 1702 includes a middle structure 1708 that includes a gap surface that forms a bridge gap with the I structure 1704 as indicated at 1710. The core structure is constructed from 0.5 mm thickness iron sheet with a surface area of 10.7 sq. cm (including gap area). The structure 1700 has a winding area of 1.68 sq. cm and a magnetic path length of 8.9 cm. Note that the bridge gap provides two symmetrical gap surfaces having the same gap height that are combined to determine inductance values.

Figure 17B:
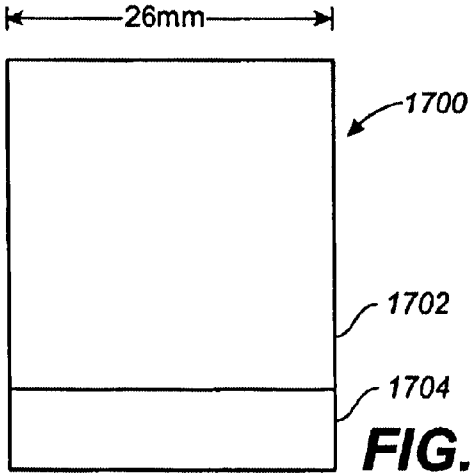
FIGS. 17*a–c* show an inductor formed from a "bridge" gapping technique in accordance with the present invention.
Figure 17A:
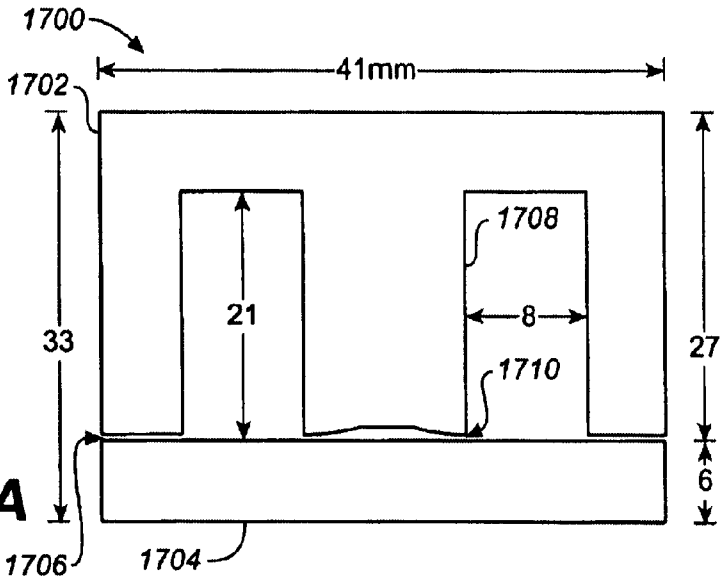

FIG. 17*a* shows a front view of the core structure 1700 and indicates that the core structure 1700 is approximately 33 mm high and 41 mm long. The E structure 1702 is 27 mm high and the I structure 1704 is 6 mm high. Also shown in the view of FIG. 17*a* is the "bridge" gap profile indicated at 1710.

Figure 17C:
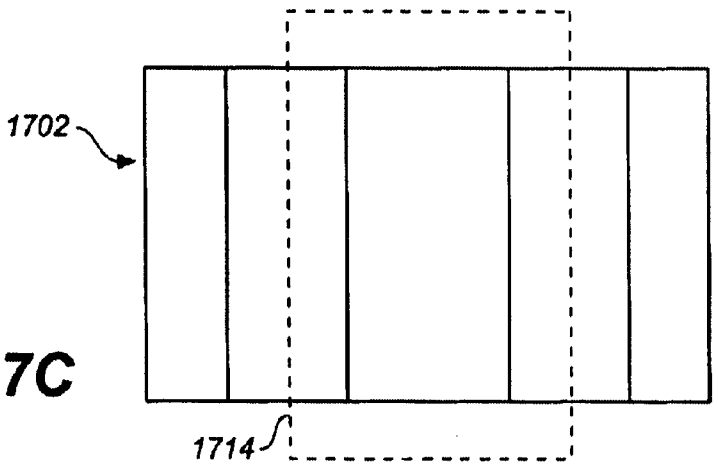

FIG. 17*b* shows an end view of the core structure 1700 and indicates that the core structure 1700 is 26 mm wide. FIG. 17*c* shows a bottom view of the E structure 1702 and indicates a path 1714 representing the average winding length of 11 cm.

Figure 18B:
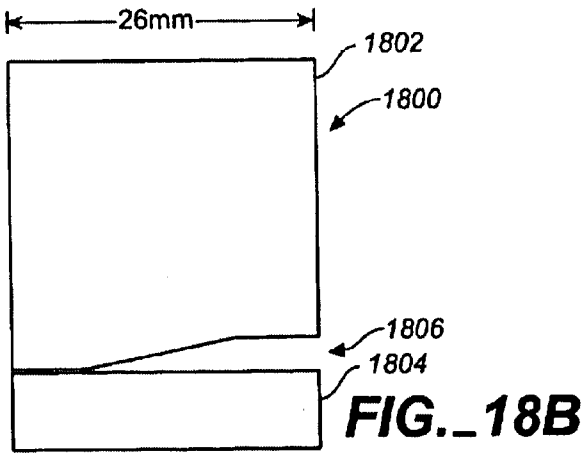
FIGS. 18*a–c* show an inductor formed from a "perpendicular" gapping technique in accordance with the present invention.
Figure 18A:
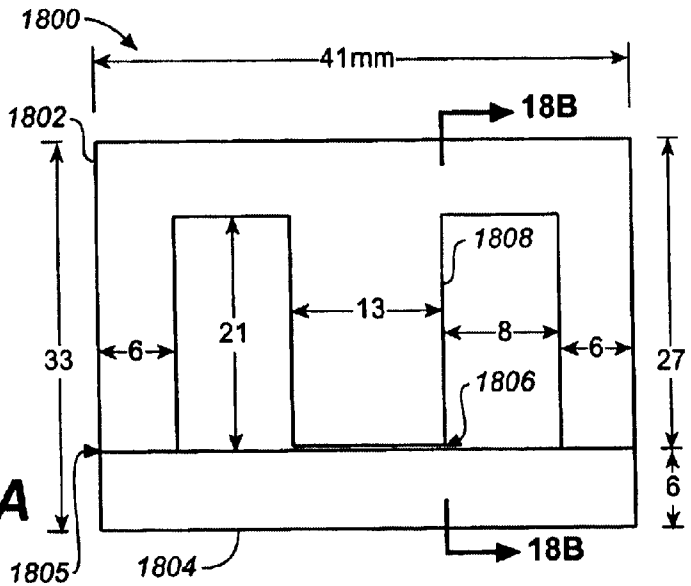
Figure 18C:
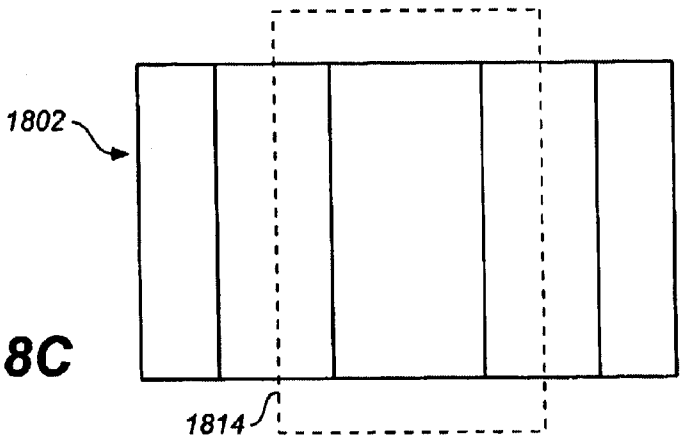

FIGS. 18*a–c* show an inductor 1800 formed from a "perpendicular" gap technique in accordance with the present invention. The inductor 1800 features a slope gap contour that is perpendicular to the facing surface of an E structure. The inductor 1800 has an E structure 1802 and an I structure 1804 that forms a gap as indicated at 1805. The E structure 1802 includes a middle structure 1808 that forms a slope gap with the I structure 1804 as indicated at 1806. The core structure is constructed from 0.5 mm thickness iron sheet with a surface area of 10.7 sq. cm (including gap area). The structure 1800 has a winding area of 1.68 sq. cm and a magnetic path length of 8.9 cm.

FIG. 18*a* shows a front view of the core structure 1800 and indicates that the core structure 1800 is approximately 33 mm high and 41 mm long. The E structure 1802 is 27 mm high and the I structure 1804 is 6 mm high. Also shown in FIG. 18*a* is a cross sectional indicator 1814 that defines a cross sectional view of the inductor 1800.

FIG. 18*b* shows a cross sectional view of the core structure 1800 taken at indicator 18B and shows that the core structure 1800 is 26 mm wide. FIG. 18*b* also shows that the gap profile 1806 is formed from a gap surface on leg 1808 that slopes from the front of the inductor to the back, thus the slope is perpendicular to the front face of the inductor. FIG. 18*c* shows a bottom view of the E structure 1802 and indicates a path 1814 representing the average winding length of 11 cm. Thus, FIGS. 18*a–c* show that the slope gap may have a differing orientations than the left to right orientation shown in previous embodiments discussed above.

Figure 19B:
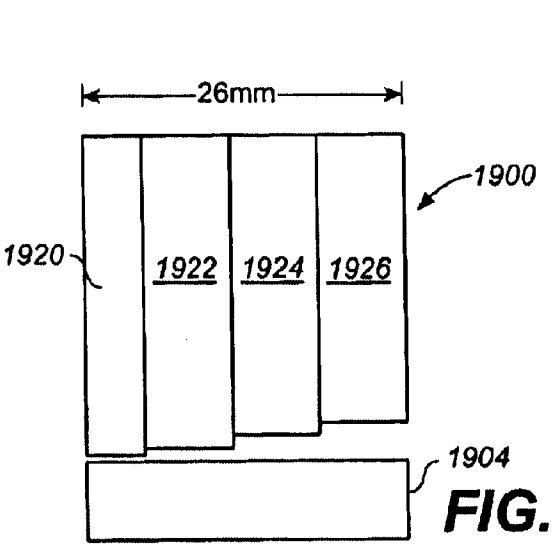
FIGS. 19*a–c* show an inductor formed from a "mixed" gapping technique in accordance with the present invention.
Figure 19A:
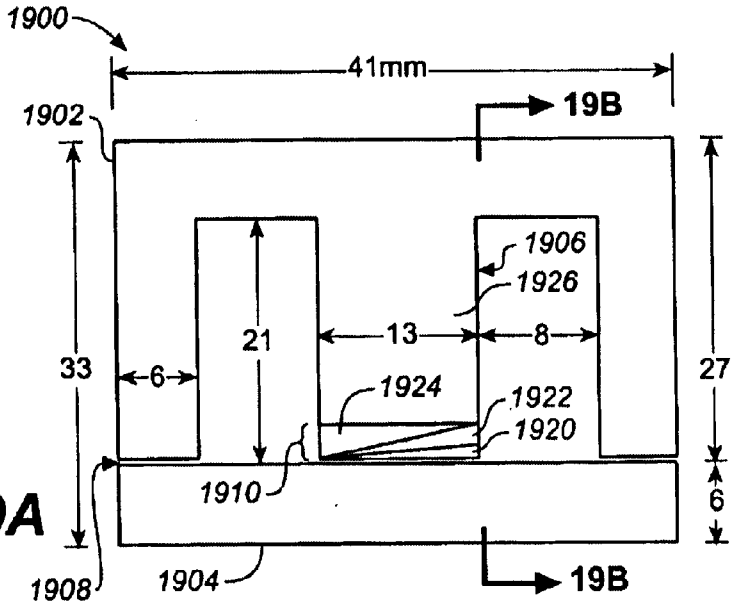
Figure 19C:
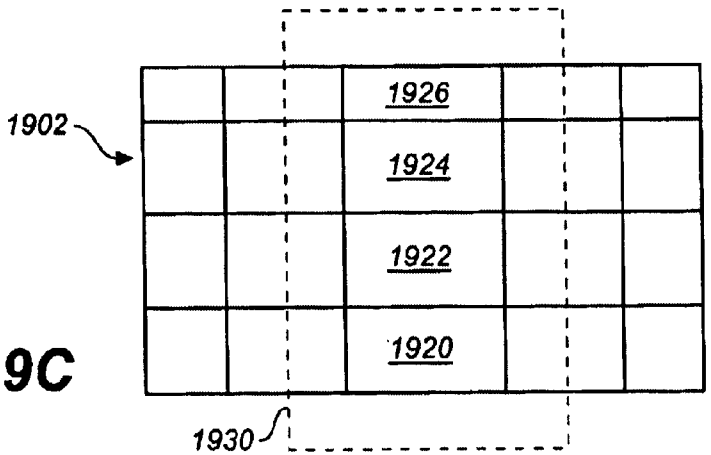

FIGS. 19*a–c* shows an inductor formed from a "mixed" slope gap technique in accordance with the present invention. The mixed slope gap inductor is formed with multiple sloped portions that are combined to determined inductance values in accordance with the present invention.

FIG. 19*a* shows a front view of an inductor core 1900 having an El structure and including a mixed slope gap. The inductor 1900 includes an E core structure 1902 and an I core structure 1904 that form a gap as indicated at 1908. The inductor 1900 is approximately 41 mm wide and 33 mm high. The inductor 1900 includes a center leg 1906 that includes a mixed slope portion 1910 that is comprised of multiple surfaces of varying slopes to provide a predetermined inductance in accordance with the present invention. A cross sectional view of the center leg 1906 is indicated at 19B.

FIG. 19*b* shows a cross sectional view of the inductor 1900 taken at indicator 19B. The cross sectional view shows a cross section of the I structure 1904 and the mixed sloped portion 1910. The cross sectional view shows individual iron sheets that are combined to form the E structure 1902. A first portion 1920 of the center leg 1906 includes a surface that forms a smallest fixed gap with the I structure 1904. A second portion 1922 of the center leg 1906 includes a sloped surface that forms a slope gap having varying height with the I structure 1904. A third portion 1924 of the center leg 1906 includes a sloped surface that forms another slope gap having varying height with the I structure 1904. A fourth portion 1926 of the center leg 1906 includes a surface that forms a largest fixed gap with the I structure 1904. Also shown in FIG. 19b is that the depth of the inductor 1900 is 26 mm. Thus, the sloped surfaces overlap each other to form the slope gap. The contribution to the inductance of each surface can be determined in accordance with the present invention by combining the surface areas of surfaces having the same gap height. It is also possible to form the mixed gap with varying numbers of surfaces having varying slope values. Thus, the mixed gap implementation provides great design flexibility while still allowing inductance values to be designed and determined in accordance with the present invention.

FIG. 19*c* is a bottom view of the E structure 1902 showing the surfaces of the mixed slope portion 1910, wherein slope gap surfaces associated with portion 1920, 1922, 1924 and 1926 are shown. The inductor 1900 core structure is constructed from iron sheets with a surface area of 10.7 sq. cm (including gap area). The inductor 1900 has a winding area of 1.68 sq. cm, a magnetic path length of 8.9 cm. and an average winding length 1930 of 11 cm shown at 1930.

The inductor 1900 may be formed with a set of iron sheets with each sheet contributing to a different gap height. For example, portion 1920 may be formed from one iron sheet and provide a surface forming the smallest fixed gap corresponding to gap a in accordance with the present invention. Portion 1926 may be formed from another iron sheet and provide a surface forming the largest fixed gap corresponding to gap c in accordance with the present invention. The portions 1922 and 1924 may each be formed from individual iron sheets and provide surfaces forming constant slope gaps that in combination form two slopes for segment b1 and segment b2, respectively, in accordance with the present invention. Therefore, the mixed gap inductor 1900 may combine slope gaps formed from multiple surfaces to provide predetermined inductance values in accordance with the present invention.

Figure 20:
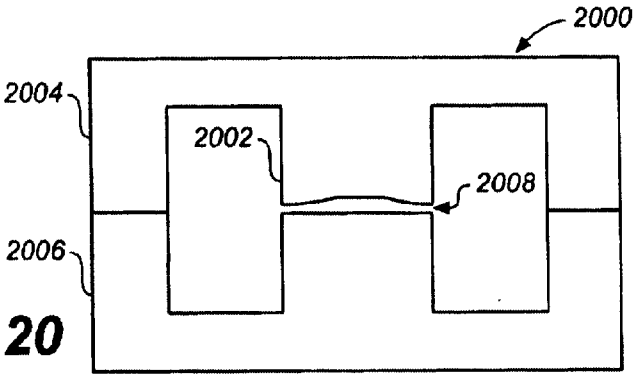
FIG. 20 shows alternative core geometry in accordance with the present invention wherein the gap is located at the center of a center leg.

FIG. 20 shows an inductor 2000 in accordance with one embodiment of the present invention wherein a "bridge" slope gap is located at a center leg 2002 of an EE core structure. The EE core structure is formed from a first E structure 2004 combined with a second E structure 2006 to form a gap 2008. In accordance with the present invention, cross sectional surface areas associated with both sides of the bridge slope gap that have the same gap height are combined to determine inductance values.

Figure 21B:
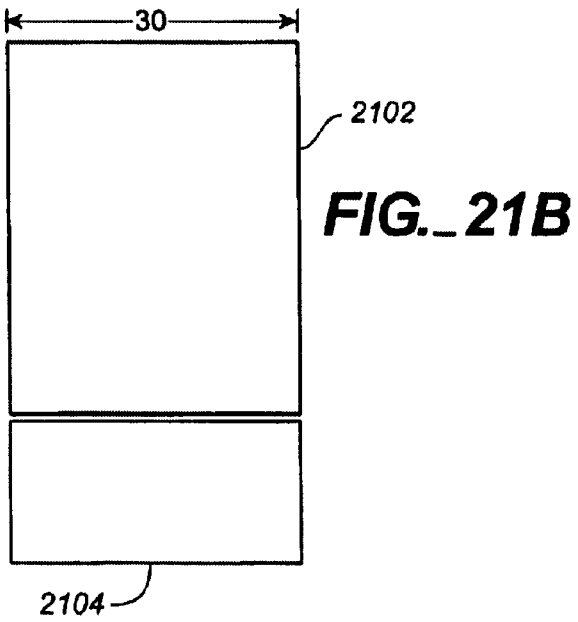
FIG. 21 shows alternative core geometry in accordance with the present invention wherein the gap is located at one leg of a CI core.
Figure 21A:
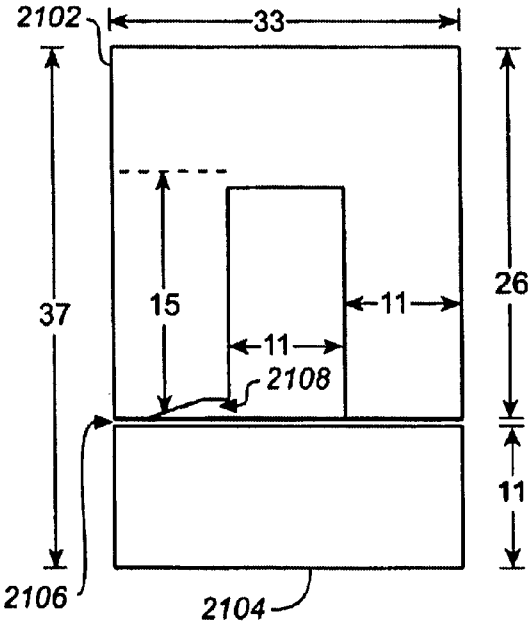
Figure 21C:
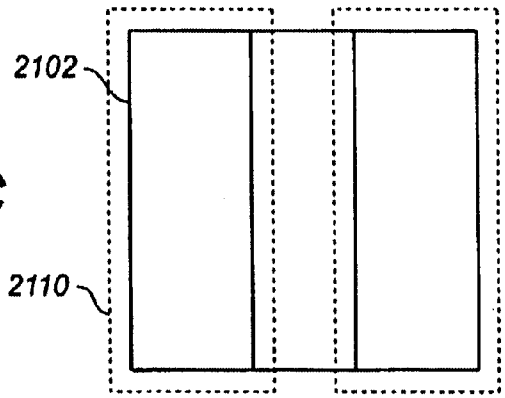

FIGS. 21*a–c* show an alternative core geometry in accordance with one embodiment of the present invention wherein the gap is located at one leg of a CI core structure. The CI core structure includes a first core element structure 2102 shaped like the letter "C" and a second core element structure 2104 shaped like the letter "I", thus the term "CI" core structure. The CI core structure includes a spacer 2106 and provides better cooling to the windings than the EI core structure does. The CI core structure is constructed from 0.5 mm thickness iron sheet with a surface area of 10.56 sq. cm (including gap area). The structure 1800 has a winding area of 1.68 sq. cm and a magnetic path length of 9.6 cm.

FIG. 21*a* shows a front view of the CI core structure and indicates that the entire structure is approximately 37 mm high and 33 mm long. A slope gap in accordance with the present invention is located at one leg of the C structure 2102 as indicated at 2108.

FIG. 21B shows a side view of the CI core structure and indicates that the depth of the structure is 30 mm and that the C structure 2102 is 26 mm high and the I structure 2104 is 11 mm high. FIG. 21*c* shows a bottom view of the C core structure 2102 and shows the average winding length for the two legs of the C structure to be 10.4 cm as indicated at 2110. Windings 2312 are indicated on each leg of the C core structure.

Figure 22:
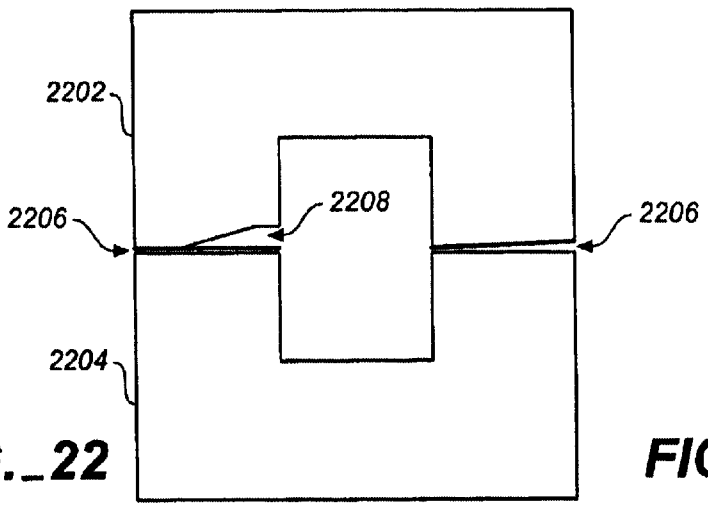
FIG. 22 shows alternative core geometry in accordance with the present invention wherein the gap is located at one leg of a CC core.

FIG. 22 shows alternative core geometry in accordance with one embodiment of the present invention wherein a slope gap is located at one leg of a CC core structure. The CC core structure includes a first core element structure 2202 shaped like the letter "C" and a second core element structure 2204 shaped like the letter "C", thus the term "CC" core structure. The CC core structure includes a spacer 2206 and provides better cooling to the windings than the El core structure does. A slope gap in accordance with the present invention is located at one leg of the C structure 2202 as indicated at 2208.

Figure 23:
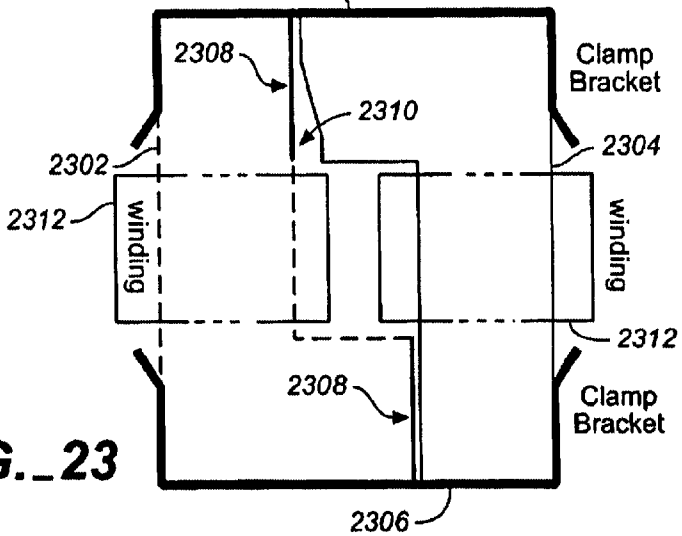
FIG. 23 shows alternative core geometry in accordance with the present invention wherein the gap is located at one leg of an LL core.

FIG. 23 shows alternative core geometry in accordance with one embodiment of the present invention wherein a slope gap is located at one leg of an LL core structure. The LL core structure includes a first core element structure 2302 shaped like the letter "L" and a second core element structure 2304 shaped like the letter "L", thus the term "LL" core structure. The LL core structure includes clamp brackets 2306 to be applied at the two ends of the core after the windings are installed, thereby making it easier to manufacture. The LL core structure also includes spacers 2308 and a slope gap as indicated at 2310.

The present invention includes a slope gap inductor core for reducing line harmonic currents. The embodiments described above are illustrative of the present invention and are not intended to limit the scope of the invention to the particular embodiments described. Accordingly, while several embodiments of the invention have been illustrated and described, it will be appreciated that various changes can be made therein without departing from the spirit or essential characteristics thereof. Accordingly, the disclosures and descriptions herein are intended to be illustrative, but not limiting, of the scope of the invention which is set forth in the following claims.

What is claimed is:

1. A slope gap inductor for use in an electronic circuit to reduce line harmonic current, the slope gap inductor comprising:

a first inductor core portion; and a second inductor core portion positioned relative to said first inductor core portion so as to form an inductor gap, wherein the second inductor core portion includes a sloped gap surface that forms a sloped gap portion of the inductor gap having a varying gap height, and wherein the sloped gap surface has a slope value that is selected so that the slope gap inductor generates an inductance value responsive to a level of current in said inductor.

2. The slope gap inductor of claim 1, wherein the second inductor core portion includes a first gap surface and a second gap surface that form a first gap portion and a second gap portion, respectively, of the inductor gap.

3. The slope gap inductor of claim 2, wherein the first gap portion has a first height characteristic and the second gap portion has a second height characteristic, wherein the first height characteristic is less than the second height characteristic.

4. The slope gap inductor of claim 3, wherein the first gap surface and the second gap surface are adjacent to the sloped gap surface.

5. The slope gap inductor of claim 4, wherein the first and second core portions comprise an "EI" core structure, and wherein the first core portion forms the "I" structure and the second core portion forms the "E" structure.

6. The slope gap inductor of claim 5, wherein the sloped gap surface is located on a middle leg structure of the "E" structure.

7. The slope gap inductor of claim 6, wherein the slope gap surface located on the middle leg structure slopes from left to right with respect to the front face of the inductor.

8. The slope gap inductor of claim 6, wherein the slope gap surface located on the middle leg structure slopes from front to back with respect to the front face of the inductor.

9. The slope gap inductor of claim 4, wherein the first and second core portions comprise a "CI" core structure, and wherein the first core portion forms the "I" structure and the second core portion forms the "C" structure.

10. The slope gap inductor of claim 9, wherein the sloped gap surface is located on a leg structure of the "C" structure.

11. The slope gap inductor of claim 4, wherein the first and second core portions comprise an "CC" core structure, and wherein the first core portion forms the first "C" structure and the second core portion forms the second "C" structure.

12. The slope gap inductor of claim 11, wherein the sloped gap surface is located on a leg structure of the first "C" structure.

13. The slope gap inductor of claim 4, wherein the first and second core portions comprise an "LL" core structure, and wherein the first core portion forms the first "L" structure and the second core portion forms the second "L" structure.

14. The slope gap inductor of claim 13, wherein the sloped gap surface is located on a leg structure of the first "L" structure.

15. The slope gap inductor of claim 1, wherein the slope gap surface is comprised of a plurality of sloped surfaces.

16. The slope gap inductor of claim 15, wherein at least two of the plurality of sloped surfaces overlap each other.

17. A method for providing a slope gap inductor for use in an electronic circuit to reduce line harmonic current, the method comprising steps of:

determining current requirements of the inductor;

determining a geometry for the inductor;

calculating a minimum and a maximum gap size;

calculating incremental gap sizes between the minimum and the maximum gap sizes;

calculating inductance values for inductor segments associated with the minimum, maximum, and incremental gap sizes;

deriving an effective average inductance for the inductor segments; and tuning the inductor segments until the effective average inductance approximates a theoretical curve.

18. The method of claim 17, wherein the step of tuning comprises a step of tuning cross sectional areas associated with the inductor segments until the effective average inductance approximates the theoretical curve.

19. The method of claim 18, further comprising a step of selecting a higher nA product when the effective average inductance is below the theoretical curve.

20. The method of claim 18, further comprising a step of selecting a lower nA product when the effective average inductance is above the theoretical curve.

* * * * *